US007071906B2

(12) United States Patent
Nishitani et al.

(10) Patent No.: US 7,071,906 B2
(45) Date of Patent: Jul. 4, 2006

(54) DISPLAY DEVICE EMPLOYING CURRENT-DRIVEN TYPE LIGHT-EMITTING ELEMENTS AND METHOD OF DRIVING SAME

(75) Inventors: Shigeyuki Nishitani, Mobara (JP); Toshihiro Sato, Mobara (JP); Genshiro Kawachi, Chiba (JP); Hajime Akimoto, Oume (JP)

(73) Assignee: Hitachi, Ltd., Tokyo (JP)

( * ) Notice: Subject to any disclaimer, the term of this patent is extended or adjusted under 35 U.S.C. 154(b) by 357 days.

(21) Appl. No.: 10/351,868

(22) Filed: Jan. 27, 2003

(65) Prior Publication Data

US 2003/0142048 A1 Jul. 31, 2003

(30) Foreign Application Priority Data

Jan. 31, 2002 (JP) ..... 2002-023204

(51) Int. Cl.
*G09G 3/32* (2006.01)

(52) U.S. Cl. ..... 345/81; 315/169.3; 345/76; 345/88

(58) Field of Classification Search ..... 345/76, 345/88, 81; 315/169.3
See application file for complete search history.

(56) References Cited

U.S. PATENT DOCUMENTS 6,016,037 A * 1/2000 Kuribayashi et al. .... 315/169.3
6,392,620 B1 * 5/2002 Mizutani et al. ..... 345/88
6,753,834 B1 * 6/2004 Mikami et al. ..... 345/76

* cited by examiner

*Primary Examiner*—Sumati Lefkowitz
*Assistant Examiner*—Alexander S. Beck
(74) *Attorney, Agent, or Firm*—Milbank, Tweed, Hadley & McCloy LL

(57) ABSTRACT

A display device includes plural red, green, and blue pixels provided with current-driven type red-, green-, and blue-light-emitting elements, respectively. A method of driving the display device includes writing a video signal voltage into each of the pixels in a state in which all the light-emitting elements cease to emit light during a first portion of one frame period at a beginning thereof, and then operating a respective one of the light-emitting elements to emit light during at least one portion of the one frame period succeeding the first portion. Each of the at least one portion of the one frame period is determined by light emission characteristics of the respective one of the light-emitting elements, and also is determined by the video signal voltage of the respective one of the pixels.

16 Claims, 9 Drawing Sheets

DISPLAY DEVICE EMPLOYING CURRENT-DRIVEN TYPE LIGHT-EMITTING ELEMENTS AND METHOD OF DRIVING SAME

BACKGROUND OF THE INVENTION

The present invention relates to a display device and a method of driving the display device and, in particular, to an active-matrix type organic electroluminescent display device.

An active-matrix type organic electroluminescent display device (hereinafter referred to as AMOLED) is expected as a next-generation flat panel display device.

Among conventional driving circuits for the AMOLED, a two-transistor circuit (hereinafter a first conventional technique) as disclosed in Japanese Patent Application Laid-Open No. 2,000-163,014 (laid open on Jun. 16, 2002) is known as the most fundamental pixel circuit. This two-transistor circuit includes a drive thin film transistor (hereinafter referred to as an EL-drive TFT) for supplying a current to an organic electroluminescent element (hereinafter referred to merely as an EL element), a storage capacitor connected to a gate electrode of the EL-drive TFT for storing a video signal voltage, and a switching thin film transistor (hereinafter referred to as a switching TFT) for supplying a video signal voltage to the storage capacitor.

A major problem that exists in the fundamental two-transistor pixel circuits is nonuniformity in a display that occurs because threshold voltages (Vth) and mobility (μ) of the EL-drive TFTs vary from pixel to pixel due to local variations in the degree of crystallinity of a semiconductor thin film (usually a polysilicon film is used) forming the EL-drive TFTs.

The variations in the threshold voltages and the mobility directly cause variations in the drive currents of the EL elements, and consequently, light emission intensity varies locally, and fine-pattern nonuniformity appears in a display. Such nonuniformity in display becomes pronounced in particular when a halftone display is produced and therefore a drive current is small.

In order to suppress the nonuniformity in display caused by the variations in the characteristics of the EL-drive TFTs, a so-called pulse width modulation driving method (hereinafter a second conventional technique) is disclosed in Japanese Patent Application Laid-Open 2,000-330,527 (laid open on Nov. 30, 2000), for example. In this driving method, EL-drive TFTs are driven as binary switches capable of assuming either of completely OFF and completely ON states, and gray scales in a display is produced by changing durations of light emission.

On the other hand, in general, red-light-emitting, green-light-emitting and blue-light-emitting organic EL elements used for the AMOLED are different from one another in light emission characteristics (light emission luminance, voltage-current characteristics, voltage-light emission luminance (brightness) characteristics, etc.). Also the variations in the light emission characteristics among the red-light-emitting, green-light-emitting and blue-light-emitting organic EL elements are observed as fine-pattern nonuniformity in a display screen as described above. In order to suppress nonuniformity in display due to the variations in the light emission characteristics among the red-light-emitting, green-light-emitting and blue-light-emitting organic EL elements, Japanese Patent Application Laid-Open No. 2,001-92,413 (laid open on Apr. 6, 2001) discloses a method (hereinafter a third conventional technique) which provides a memory storing gamma correction tables for red (R), green (G) and blue (B) video signals to be supplied to red-light-emitting, green-light-emitting and blue-light-emitting organic EL elements, respectively, and selects proper gamma correction values for each of the red (R), green (G) and blue (B) video signals.

SUMMARY OF THE INVENTION

The above-described conventional techniques poses the following problems.

An improvement on uniformity of displayed images by the second conventional technique has been already established, and the pulse width modulation driving method is one of the predominant driving methods for AMOLED. However, in the second conventional technique, it is necessary to process short signal pulses corresponding to digitized gray scales, and consequently, operating frequencies of the driving circuits are increased, resulting in a problem of increase in power consumption of the circuits. In addition, there is another problem in that a vertical scanning circuit which otherwise is simple in configuration becomes complex, and increases an area occupied by the circuit.

The third conventional technique needs an A/D converter, a D/A converter and a corrective memory for storing gamma correction tables for performing the gamma correction, and consequently, this technique poses a problem of the complex configuration and an increase in cost. Further, the third conventional technique does not take into consideration local variations in characteristics such as the variations in luminance among pixels, and can not eliminate the local variations in the characteristics such as the variations in luminance among pixels.

The present invention is made in order to solve these problems in the prior art. It is an object of the present invention to provide a method of driving a display device employing current-driven light-emitting elements such as EL-elements, and capable of making red, green and blue pixels emit light with their luminances well-balanced among them by using a driving circuit simpler in configuration as compared with the conventional techniques.

It is another object of the present invention to provide a display device suitable for carrying out the above-mentioned driving method of the present invention.

The above-mentioned and other objects and novel features of the present invention will be made clear by the descriptions and the accompanying drawings.

The representative structures of the present invention are as follows:

In accordance with an embodiment of the present invention, there is provided a method of driving a display device, said display device including a plurality of red pixels each provided with a current-driven type red-light-emitting element, a plurality of green pixels each provided with a current-driven type green-light-emitting element, and a plurality of blue pixels each provided with a current-driven type blue-light-emitting element, said method comprising: writing a video signal voltage into each of said red, green, and blue pixels in a state in which all of said red-light-emitting, green-light-emitting, and blue-light-emitting elements cease to emit light, during a first portion of one frame period at a beginning thereof; and then operating a respective one of said current-driven type red-light-emitting, green-light-emitting, and blue-light-emitting elements to emit light during at least one portion of said one frame period succeeding said first portion, wherein each of said at least one portion of said one frame period is determined by light emission characteristics associated with said respective one of said current-driven type red-light-emitting, green-light-emitting, and blue-light-emitting elements, and also is determined by said video signal voltage associated with said respective one of said red, green, and blue pixels.

In accordance with another embodiment of the present invention, there is provided a method of driving a display device, said display device including a plurality of red pixels each provided with a current-driven type red-light-emitting element, a switching transistor, and a storage capacitance element coupled to said switching transistor, a plurality of green pixels each provided with a current-driven type green-light-emitting element, a switching transistor, and a storage capacitance element coupled to said switching transistor, and a plurality of blue pixels each provided with a current-driven type blue-light-emitting element, a switching transistor, and a storage capacitance element coupled to said switching transistor, said method comprising: writing a video signal voltage into said storage capacitance element of a respective one of said red, green, and blue pixels by applying a scanning drive signal on a gate electrode of said switching transistor of said respective one of said red, green, and blue pixels in a state in which all of said current-driven type red-light-emitting, green-light-emitting, and blue-light-emitting elements cease to emit light, during a first portion of one frame period at a beginning thereof; and then ceasing to apply said scanning drive signal on said gate electrode of said switching transistor of each of said red, green, and blue pixels and operating said respective one of said red-light-emitting, green-light-emitting, and blue-light-emitting elements to emit light during at least one portion of said one frame period succeeding said first portion, wherein each of said at least one portion of said one frame period is determined by light emission characteristics associated with said respective one of said red-light-emitting, green-light-emitting, and blue-light-emitting elements, and also is determined by one of said video signal voltage stored in said storage capacitance element associated with said respective one of said red pixels, green, and blue pixels.

In accordance with another embodiment of the present invention, there is provided a display device comprising: a plurality of red pixels each provided with a current-driven type red-light-emitting element; a plurality of green pixels each provided with a current-driven type green-light-emitting element; a plurality of blue pixels each provided with a current-driven type blue-light-emitting element, each of said red, green and blue pixels being provided with a drive transistor for supplying a drive current to a corresponding one of said current-driven type red-light-emitting, green-light-emitting, and blue-light-emitting elements, a switching transistor, a storage capacitance element coupled to said switching transistor, a comparator with an output terminal thereof coupled to a gate electrode of said drive transistor, a first input terminal of said comparator supplied with a voltage stored in said storage capacitance element and a second input terminal of said comparator supplied with a gray scale control voltage; a first circuit for writing a video signal voltage into said storage capacitance element of a respective one of said red, green, and blue pixels during a first portion of one frame period at a beginning thereof by applying a scanning drive signal on a gate electrode of said switching transistor of said respective one of said red, green, and blue pixels; and a second circuit for supplying, as said gray scale control voltage, a first voltage of a first level for turning off all of said drive transistors during said first portion of said one frame period, then at least one ramp voltage varying from said first voltage of said first level to a second voltage of a second level different from said first level during a second portion of said one frame period succeeding said first portion, wherein a waveform of each of said at least one ramp voltage is determined by light emission characteristics associated with a corresponding one of said current-driven type red-light-emitting, green-light-emitting, and blue-light-emitting elements.

In accordance with another embodiment of the present invention, there is provided a display device comprising: a plurality of red pixels each provided with a current-driven type red-light-emitting element; a plurality of green pixels each provided with a current-driven type green-light-emitting element; a plurality of blue pixels each provided with a current-driven type blue-light-emitting element, each of said red, green and blue pixels being provided with an inverter circuit having an output terminal thereof coupled to a corresponding one of said current-driven type red-light-emitting, green-light-emitting, and blue-light-emitting elements, a switching transistor, a storage capacitance element coupled between said switching transistor and an input terminal of said inverter circuit; a first circuit for short-circuiting between said input and output terminals of said inverter circuit of each of said red, green and blue pixels during a first portion of one frame period at a beginning thereof; a second circuit for writing a video signal voltage into said storage capacitance element of a respective one of said red, green, and blue pixels by applying a scanning drive signal on a gate electrode of said switching transistor of said respective one of said red, green, and blue pixels, during a second portion of said one frame period succeeding said first portion; a third circuit for supplying at least one ramp-shaped gray scale control voltage varying from a first voltage of a first level to a second voltage of a second level different from said first level to said first terminal of said storage capacitance element of a respective one of said red, green, and blue pixels during a third portion of said one frame period succeeding said second portion, wherein a waveform of each of said at least one ramp-shaped gray scale control voltage is determined by light emission characteristics associated with a corresponding one of said current-driven type red-light-emitting, green-light-emitting, and blue-light-emitting elements.

In accordance with another embodiment of the present invention, there is provided a method of driving a display device having a plurality of pixels each provided with a current-driven type light-emitting element, said method comprising: writing a video signal voltage into a respective one of said plurality of pixels in a state in which all of said current-driven type light-emitting elements cease to emit light, during a first portion of one frame period at a beginning thereof; and then operating said current-driven type light-emitting element of a respective one of said plurality of pixels to emit light during at least one portion of said one frame period succeeding said first portion, wherein each of said at least one portion of said one frame period is determined by said video signal voltage associated with said respective one of said plurality of pixels.

In accordance with another embodiment of the present invention, there is provided a method of driving a display device, said display device including a plurality of pixels each provided with a current-driven type light-emitting element, a switching transistor, and a storage capacitance element coupled to said switching transistor, said method comprising: writing a video signal voltage into said storage capacitance element of a respective one of said plurality of pixels by applying a scanning drive signal on a gate electrode of said switching transistor of said respective one of said plurality of pixels in a state in which all of said plurality of current-driven type light-emitting elements cease to emit light, during a first portion of one frame period at a beginning thereof; and then ceasing to apply said scanning drive signal on said gate electrode of said switching transistor of said respective one of said plurality of pixels and operating said respective one of said plurality of light-emitting elements to emit light during at least one portion of said one frame period succeeding said first portion, wherein each of said at least one portion of said one frame period is determined by said video signal voltage stored in said storage capacitance element associated with said respective one of said plurality of pixels.

In accordance with another embodiment of the present invention, there is provided a display device comprising: a plurality of pixels, each of said pixels being provided with a current-driven type light-emitting element, a drive transistor for supplying a drive current to said current-driven type light-emitting element, a switching transistor, a storage capacitance element coupled to said switching transistor, a comparator with an output terminal thereof coupled to a gate electrode of said drive transistor, a first input terminal of said comparator supplied with a voltage stored in said storage capacitance element, and a second input terminal of said comparator supplied with a gray scale control voltage; a first circuit for writing a video signal voltage into said storage capacitance element of a respective one of said plurality of pixels during a first portion of one frame period at a beginning thereof by applying a scanning drive signal on a gate electrode of said switching transistor of said respective one of said plurality of pixels; and a second circuit for supplying, as said gray scale control voltage, a first voltage of a first level for turning off said drive transistor in said respective one of said plurality of pixels during said first portion of said one frame period, then at least one ramp voltage varying from said first voltage of said first level to a second voltage of a second level different from said first level during a second portion of said one frame period succeeding said first portion.

In accordance with another embodiment of the present invention, there is provided a display device comprising: a plurality of pixels, each of said plurality of pixels being provided with a current-driven type light-emitting element, an inverter circuit having an output terminal thereof coupled to said current-driven type light-emitting elements, a switching transistor, a storage capacitance element coupled between said switching transistor and an input terminal of said inverter circuit; a first circuit for short-circuiting between said input and output terminals of said inverter circuit of each of said plurality of pixels during a first portion of one frame period at a beginning thereof; a second circuit for writing a video signal voltage into said storage capacitance element of a respective one of said plurality of pixels by applying a scanning drive signal on a gate electrode of said switching transistor of said respective one of said plurality of pixels, during a second portion of said one frame period succeeding said first portion; a third circuit for supplying at least one ramp-shaped gray scale control voltage varying from a first voltage of a first level to a second voltage of a second level different from said first level to said first terminal of said storage capacitance element of a respective one of said plurality of pixels during a third portion of said one frame period succeeding said second portion.

BRIEF DESCRIPTION OF THE DRAWINGS

In the accompanying drawings, in which like reference numerals designate similar components throughout the figures, and in which.

DETAILED DESCRIPTION OF THE PREFERRED EMBODIMENTS

Figure 1:
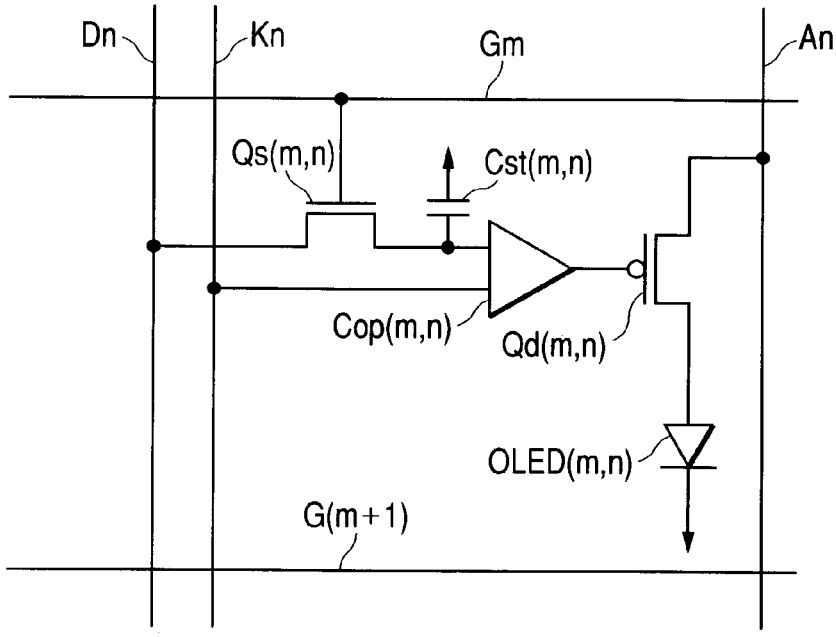
FIG. 1 is a circuit diagram showing an equivalent circuit of a pixel in a display panel of a display device in Embodiment 1 according to the present invention.

The preferred embodiments according to the present invention will be described in detail below with reference to the drawings.

In all figures for explaining the embodiments, components performing the same functions are denoted with like reference numerals or characters, and their explanations are not repeated.

Embodiment 1

FIG. 1 is a circuit diagram showing an equivalent circuit of a pixel in a display panel of a display device in Embodiment 1 according to the present invention.

In the present embodiment, pixels are arranged in a matrix configuration, and a pixel in an mth row and an nth column is defined as an area surrounded by scanning lines (Gm, G(m+1)), and a video signal line Dn and a gray scale signal line Kn and an anode current supply line An.

There are provided in each pixel a switching thin-film transistor (hereinafter referred to as a switching TFT) (Qs (m,n)), an EL-drive TFT (Qd (m,n)) composed of a PMOS transistor, a storage capacitance element (Cst (m,n)) and a comparator (Cop (m,n)). An anode electrode of an EL element (OLED (m,n)) is connected to a drain electrode of the EL-drive TFT (Qd (m,n)) and a gate electrode of the EL-drive TFT (Qd (m,n)) is connected to an output terminal of the comparator (Cop (m, n)). A cathode electrode of the EL element (OLED (m,n)) is connected to ground (GND). A first terminal of the storage capacitance element (Cst (m,n)) is connected to one input terminal of the comparator (Cop (m,n)). The gray scale signal line Kn is connected to the other input terminal of the comparator(Cop (m,n)). Further, the first terminal of the storage capacitance element (Cst (m,n)) is connected to the video signal line Dn via the switching TFT (Qs (m,n)), and the second terminal of the storage capacitance element (Cst (m,n)) is connected to ground (GND).

Figure 10:
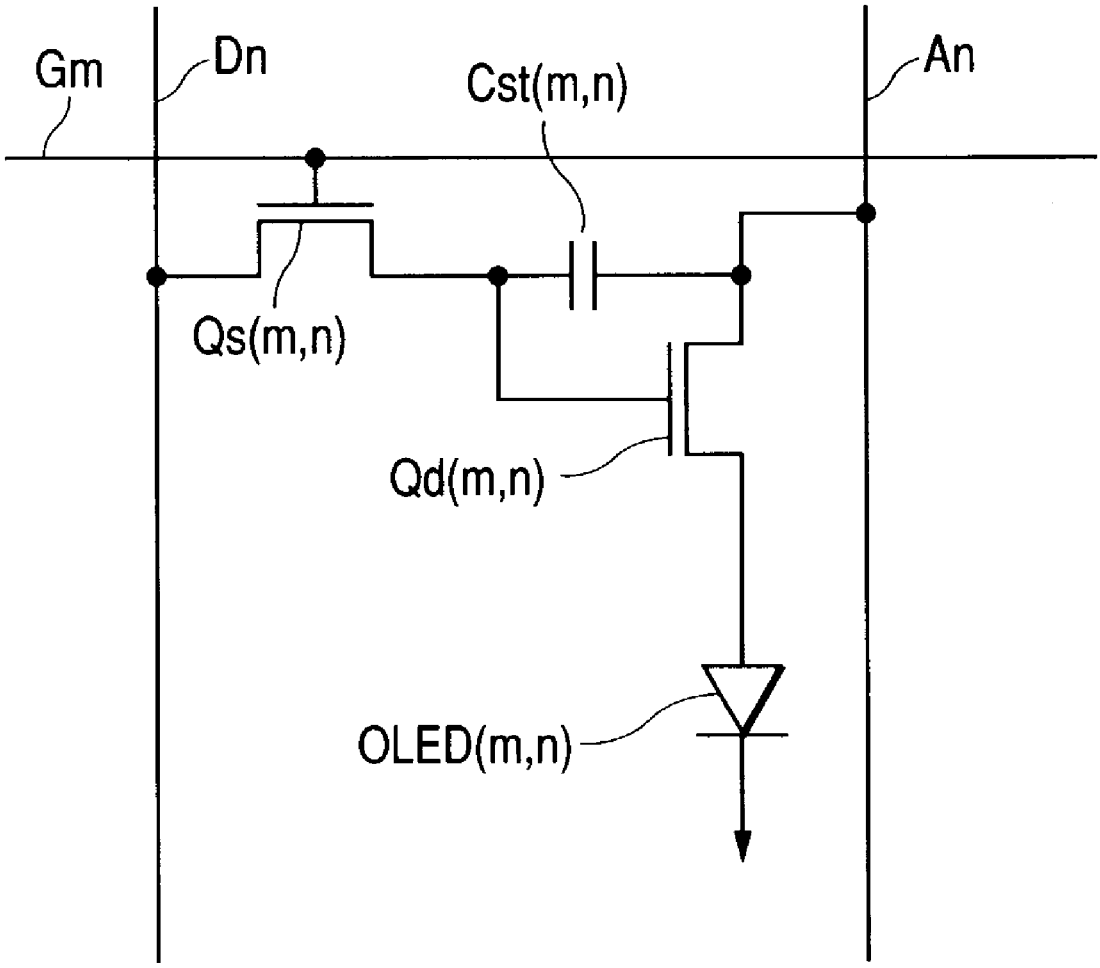
FIG. 10 PRIOR ART
FIG. 10 is a circuit diagram showing an equivalent circuit of a pixel in a display panel of a conventional display device.

For comparison purposes, FIG. 10 illustrates an equivalent circuit of a representative pixel in a conventional display device. This equivalent circuit of FIG. 10 is disclosed in the above-noted Japanese Patent Application Laid-Open No. 2,000-163,014. The equivalent circuit of FIG. 10 differs from that of FIG. 1 in that the equivalent circuit shown in FIG. 10 is not provided with the comparator (Cop(m,n)) and the gray scale signal line (Kn), and the second terminal of the storage capacitance element (Cst (m,n)) is connected to the anode current supply line (An).

In the equivalent circuit shown in FIG. 10, the scanning signal lines (G) are successively scanned line by line. When a scanning clock of a high level (hereinafter an H level) is applied on a gate electrode of the switching TFT (Qs (m,n)), the switching TFT (Qs (m,n)) is turned ON, thereby an analog video signal voltage is supplied to the storage capacitance element (Cst (m,n)) from the video signal line (Dn) via the switching TFT (Qs (m,n)), and is stored in the storage capacitance element (Cst (m,n)). The analog video signal voltage stored in the storage capacitance element (Cst (m,n)) is supplied to the gate electrode of the EL-drive TFT (Qd (m,n)). Thus, a current which flows in the EL-drive TFT (Qd (m,n)) is controlled, that is to say, the current which corresponds to the analog video signal voltage is supplied to the EL element (OLED (m,n)), and makes the EL element (OLED (m,n)) emit light and thereby display an image.

However, in the circuit configuration shown in FIG. 10, local variations in the degree of crystallinity of semiconductor thin films (usually polycrystalline silicon films which will be hereinafter referred to as polysilicon films) forming the EL-drive TFTs (Qd (m,n)) cause variations in threshold voltages (Vth) and mobility (μ) of the EL-drive TFTs (Qd (m,n)) from pixel to pixel. These variations causes variations in drive current of the EL element (OLED (m,n)) and as a result, variations in light emission intensity are caused such that fine-pattern nonuniformity are observed in a display.

Moreover, the driving method shown in FIG. 10 continues to display identical images during one frame period and luminance changes stepwise with changes of displayed images. With the driving method of displaying images continuously at all times in this manner, when one image is superseded by a subsequent image, the human eye perceives the two images as superimposed. As a result, the contours of the image are blurred. In particular, when a moving picture is displayed, the picture quality is degraded.

The following explains a driving method of the present embodiment.

Figure 2:
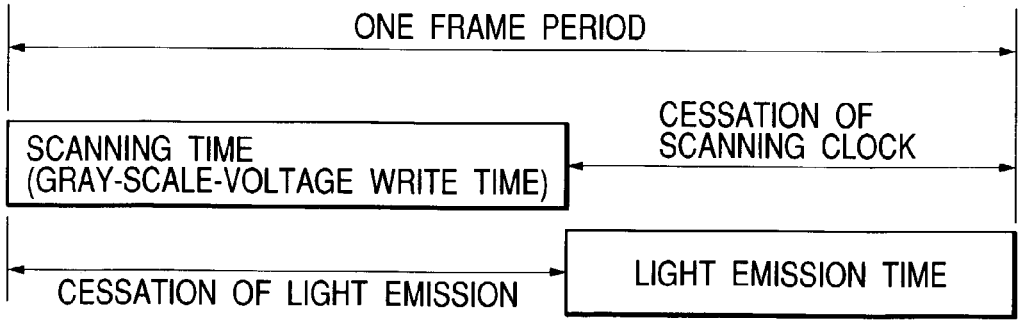
FIG. 2 is an illustrative diagram for explaining a driving method of the display device in Embodiment 1 according to the present invention.

In the present embodiment, as shown in FIG. 2, one frame period is divided into a scanning time and a light emission time.

The scanning time shown in FIG. 2 is a time for writing analog video signal voltages into all the storage capacitance elements (Cst), and during this scanning time, the light emission of the EL elements (OLED) ceases.

During the scanning time, the scanning signal lines (G) are successively scanned line by line such that they are successively supplied with scanning clocks line by line, the analog video signal voltages are written into all storage-capacitance elements (Cst).

In FIG. 1, when a scanning clock of the H level is applied on the gate electrode of the switching TFT (Qs(m,n)), the switching TFT (Qs (m,n)) is turned ON, thereby the analog video signal voltages from the video signal line Dn are supplied to the storage capacitance element (Cst (m,n)) via the switching TFT (Qs (m,n)), and they are stored in the storage capacitance elements (Cst (m,n)).

Figure 3:
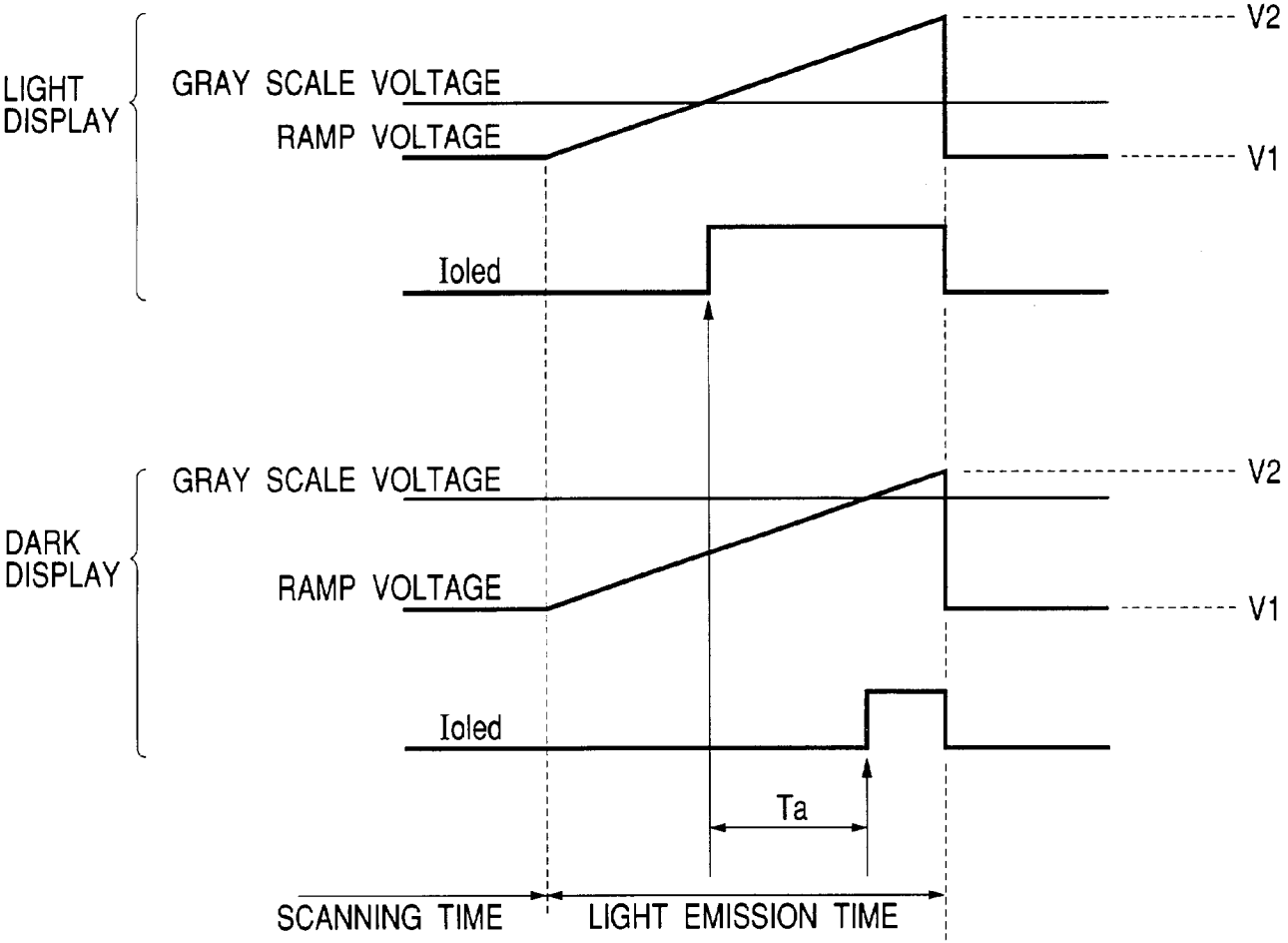
FIG. 3 is a diagram showing voltage waveforms of ramp voltages supplied on a gray scale signal line in the display device in Embodiment 1 according to the present invention.

In the present embodiment, a ramp voltage shown in FIG. 3 is applied on the gray scale signal line (Kn). The ramp voltage shown in FIG. 3 is at a first level voltage (V1) during the scanning time. Since the first level voltage (V1) is input to the comparator (Cop (m,n)), the output of the comparator (Cop (m,n)) holds the H level. Accordingly, all the EL-drive TFTs (Qd) are held OFF and all the EL elements (OLED) cease to emit light. In other words, all the EL elements (OLED) produce a black display during the scanning period.

During the light emission time succeeding the above-mentioned scanning time, the supply of the scanning clocks to the scanning signal lines (G) ceases. During the light emission time, the ramp voltage supplied to the gray scale signal lines (Kn) varies from a first-level voltage (V1) to a second-level voltage (V2) with a specified slope as shown in FIG. 3. Therefore, when the ramp voltage supplied to the gray-scale signal line (Kn) becomes higher than a voltage (designated as GRAY SCALE VOLTAGE in FIG. 3) stored in the storage capacitance element (Cst), the output of the comparator (Cop) goes to the Low level (hereinafter the L level) and thereby the EL-drive TFT (Qd) is turned ON and the EL element (OLED) emits light. In this case, a current (Ioled in FIG. 3) flowing in each of the EL elements is fixed, and consequently, the light emission luminance of one of the pixels varies with a length of time within the light emission time during which a corresponding one of the EL elements (OLED) continue to emit light, and this length of time will be hereinafter referred to as the EL-luminescent time. As shown in FIG. 3, a pixel intended to produce higher luminance of light emission, which is a lighter pixel, provides a longer EL-luminescent time to its EL element (OLED).

In the present embodiment, the EL-drive TFT (Qd) is driven as a binary switch capable of assuming either of completely OFF and completely ON states, and consequently, this makes it possible to suppress nonuniformity in display that occurs due to variations in threshold voltages (Vth) and mobility (μ) in EL-drive TFTs (Qd) from pixel to pixel, which are caused by local variations in degree of crystallinity of semiconductor thin films (usually polysilicon films) of the EL-drive TFTs (Qd).

The present embodiment is similar to the second conventional technique, since the EL-drive TFTs (Qd) are driven as binary switches and gray scales in a display is produced by by varying the duration of light emission of the EL element (OLED). However, the present embodiment has eliminated the need for process in short signal pulses corresponding to digitized gray scales, unlike the second conventional technique, and consequently, the present embodiment makes it possible to lower operating frequencies of the driver circuits, simplify the configuration of the vertical scanning circuit, and reduce an area occupied by the circuit, as compared with those in the second conventional technique.

Further, the present embodiment cease to apply scanning clocks on gate electrodes of the switching TFTs (Qs) during the light emission time, and therefore is capable of suppressing increase in power consumption.

In the present embodiment, as shown in FIG. 3, the higher the luminance of light emission, the smaller a voltage difference between an analog video signal voltage stored in the storage capacitance element (Cst) and the first-level voltage (V1), and the lower the luminance of light emission, the larger the voltage difference between the analog video signal voltage stored in the storage capacitance element (Cst) and the first-level voltage (V1).

As mentioned above, the present embodiment is configured such that all the EL elements (OLED) cease to emit light during a scanning time within one frame period, and consequently is capable of reducing degradation in display quality even when moving pictures are displayed.

Figure 4:
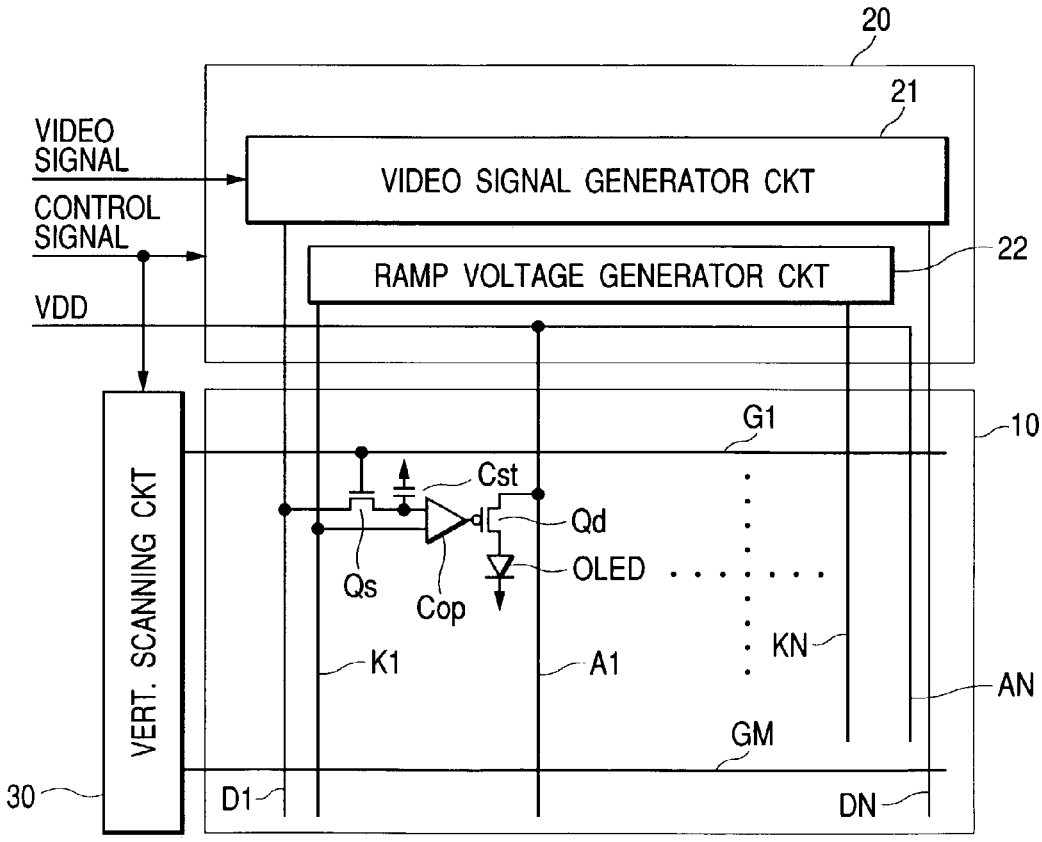
FIG. 4 is a block diagram showing an entire display section including a matrix display section and a driving circuit in the display device shown in Embodiment 1 according to present invention.

FIG. 4 is a block diagram showing the whole display section including a matrix display section and the driver circuits in the present embodiment In FIG. 4, reference numeral 10 denotes a display panel, 20 denotes a horizontal scanning circuit and 30 denotes a vertical scanning circuit. The horizontal scanning circuit 20 and the vertical scanning circuit 30 are controlled by control signals such as clock pulses and start pulses from an external timing controller. The horizontal scanning circuit 20 is composed of a video signal generator circuit 21 and a ramp voltage generator circuit 22.

In FIG. 4, M scanning signal lines (G1 to GM) are connected to the vertical scanning circuit 30, which supplies scanning clocks of the H level to the M scanning signal lines successively during the scanning period. In FIG. 4, only two signal lines G1 and G2 are shown.

N video signal lines (D1 to DN) are connected to the video signal generator circuit 21, which supplies, to the N video signal lines, analog video signal voltages intended for pixels on one of the scanning lines scanned during one horizontal scanning period, based upon video signal from an external circuit signal line. In FIG. 4, only two video signal lines D1 and D2 are shown. Although, in the present embodiment, the display panel 10 is composed of pixels of M rows and N columns, FIG. 4 indicates only one pixel.

N gray scale signal lines (K1 to KN) are connected to the ramp voltage generator circuit 22 which generates the above-explained ramp voltages. N anode current supply lines (A1 to AN) are connected together outside of the pixel area and are electrically connected to an external power supply (VDD).

Embodiment 2

In the case of the display device of the embodiment 1, in FIG. 3, if a time difference (Ta) between a time of start of of light emission of the EL element (OLED) for a light display and a time of start of light emission of the EL element (OLED) for a dark display is large, blurs or false contour noises appear in displayed moving pictures, and may degrade quality of displayed images.

Figure 5:
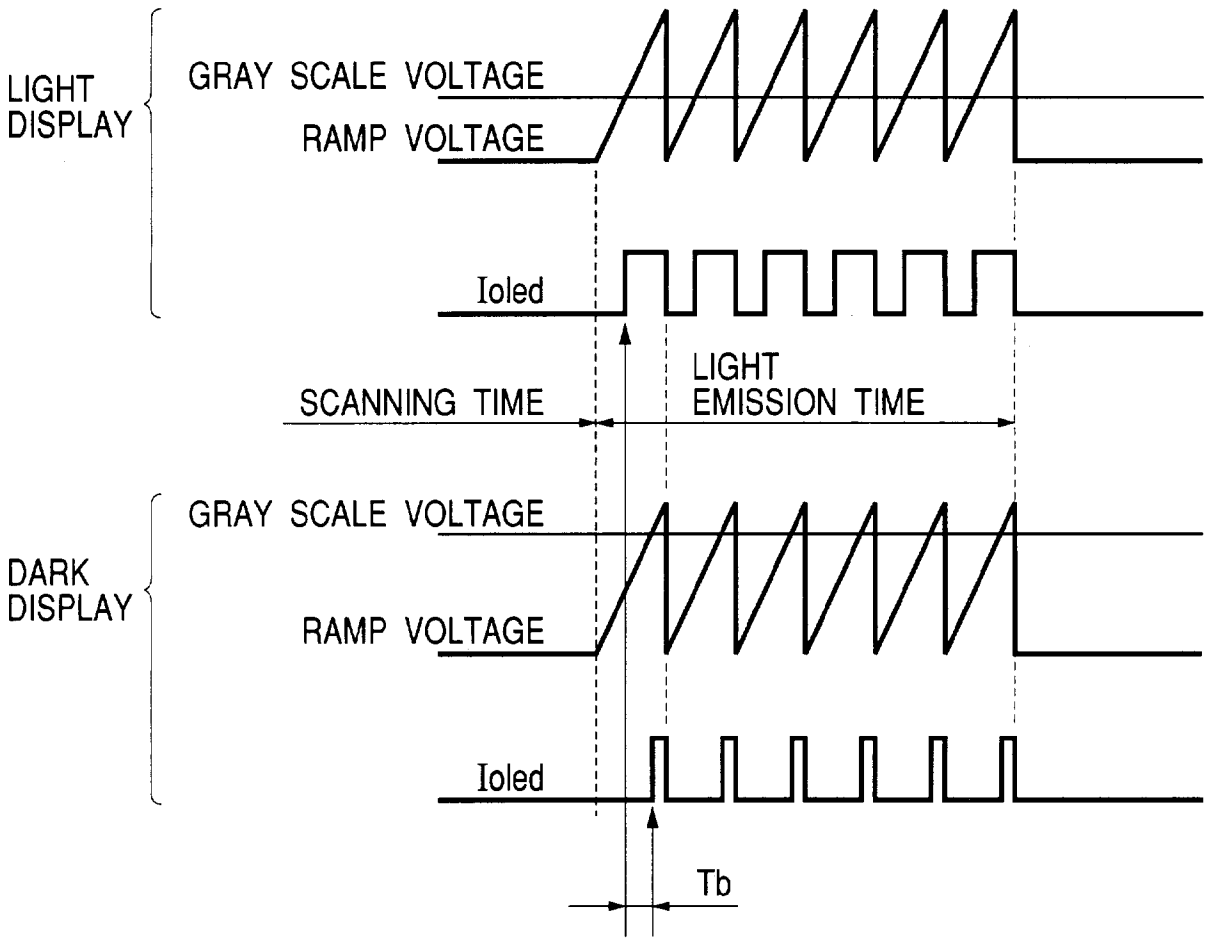
FIG. 5 is a diagram showing voltage waveforms of ramp voltages supplied on a gray scale signal line in a display device shown in Embodiment 2 according to the present invention.

A display device of the present embodiment is intended to prevent the above-mentioned degradation in the quality of displayed images. FIG. 5 illustrates waveforms of ramp voltages supplied to the gray scale signal line (K) in Embodiment 2 according to the present invention.

The ramp voltage shown in FIG. 3 varies only once from the voltage (V1) of the first level to the voltage (V2) of the second level during one light emission time, but, in FIG. 5 the ramp voltages vary from the first-level voltage (V1) to the second-level voltage (V2) plural times (six times in FIG. 5) during one light emission time.

Thus, in the present embodiment as shown in FIG. 5, a time difference (Tb) between a time of start of light emission of the EL element (OLED) for a light display and a time of start of light emission of the EL element (OLED) for a dark display is made smaller than the corresponding time difference (Ta) shown in FIG. 3. Consequently, the present embodiment is capable of preventing occurrence of blurs or false contour noise in displayed moving pictures. The ramp voltages shown in FIG. 5 are generated in a ramp voltage generator circuit 22 shown in FIG. 4.

Embodiment 3

Figure 6:
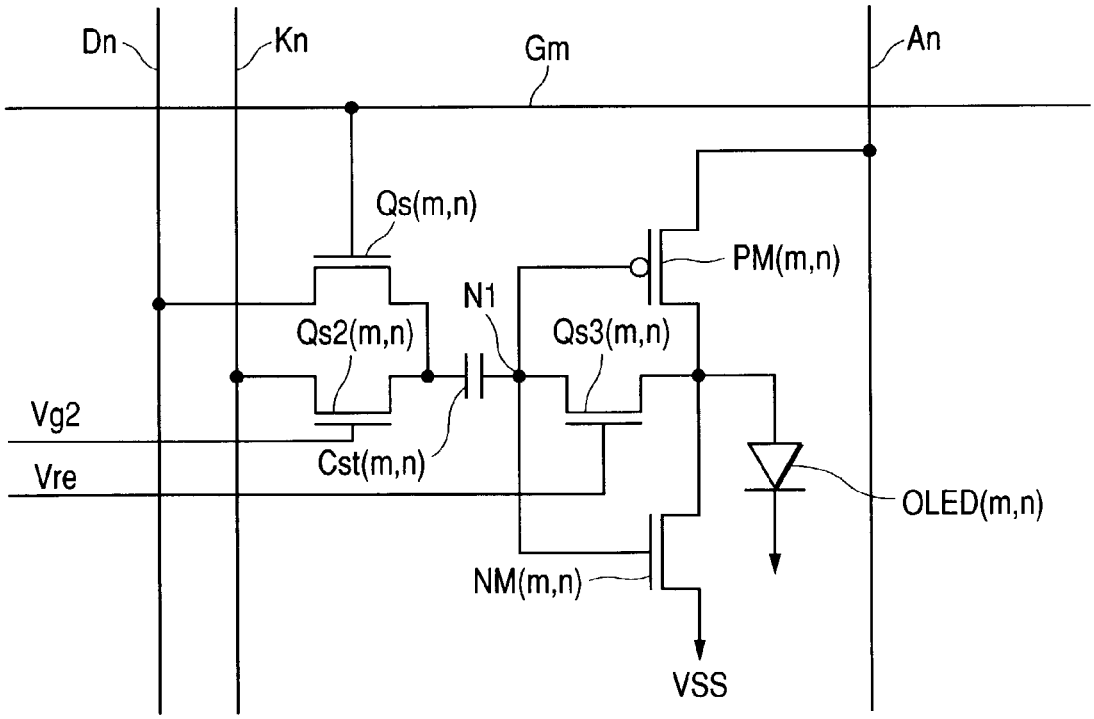
FIG. 6 is a circuit diagram showing an equivalent circuit of a pixel in a display panel of a display device in Embodiment 3 according to the present invention.

FIG. 6 is a circuit diagram illustrating an equivalent circuit of a pixel in a display panel of a display device of Embodiment 3 according to the present invention.

The present embodiment employs a clamped inverter circuit in place of the comparator (Cop) shown in the above-explained embodiments.

In the present embodiment, the clamped inverter circuit is composed of a PMOS transistor (PM (m,n)) and an NMOS transistor (NM (m,n)), and has its output terminal connected to an anode electrode of the EL element (OLED (m,n)), and the EL element (OLED (m,n)) is supplied with a drive current from the PMOS transistor (PM (m,n)).

A switching thin film transistor (hereinafter referred to as a third switching TFT.) (Qs3 (m,n)) is connected between an input terminal and the output terminal of the inverter circuit. One terminal of the storage capacitance element (Cst (m,n)) is connected to the input terminal of the inverter circuit, and the other terminal of the storage capacitance element (Cst (m,n)) is connected to the video signal line (Dn) via the switching TFT (Qs (m,n)), and is also connected to the gray scale signal line (Kn) via a switching thin film transistor (hereinafter referred to as a second switching TFT.) (Qs2 (m,n)).

Figure 7:
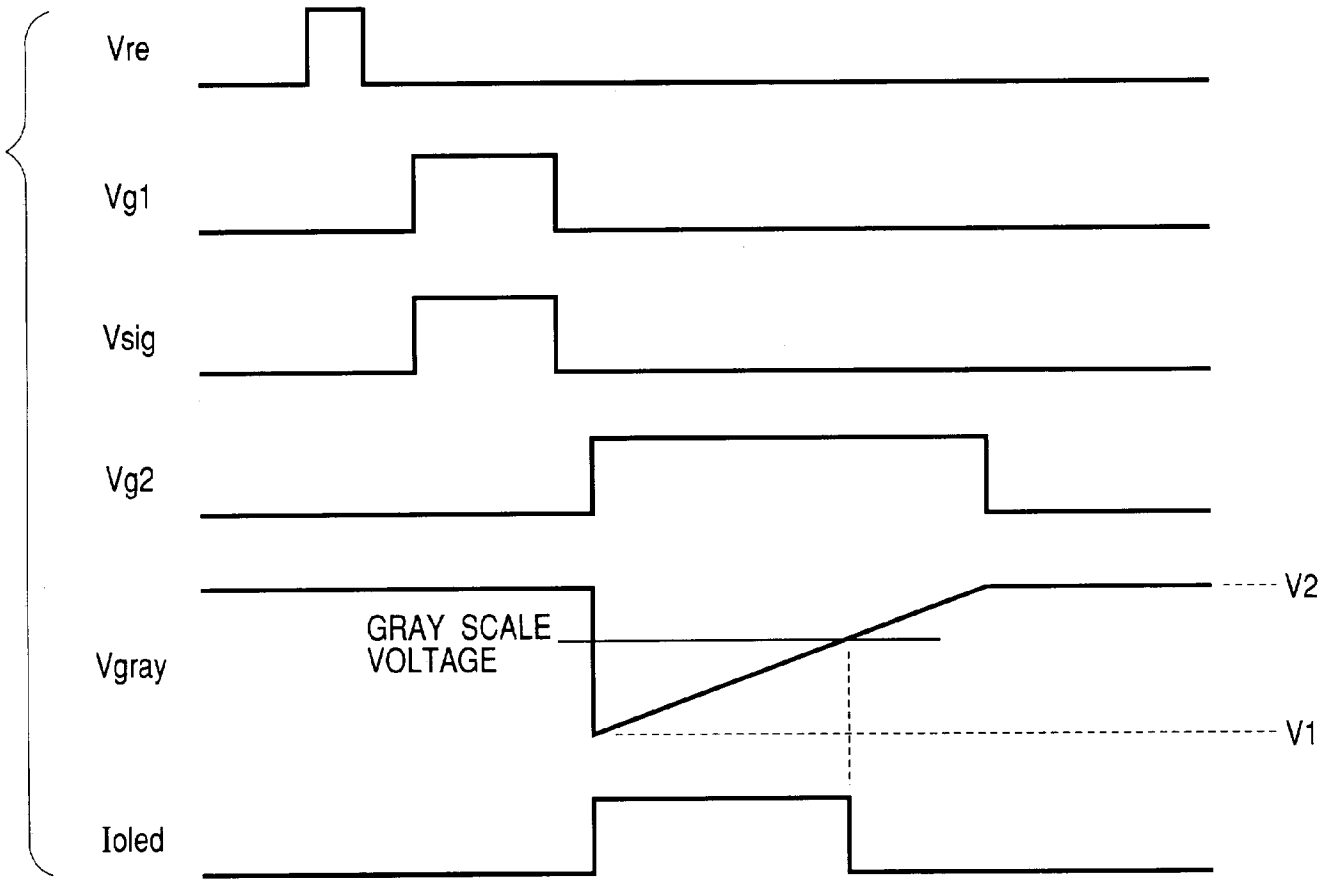
FIG. 7 is a diagram showing waveforms of voltages applied on gate electrodes of respective switching TFTs shown in FIG. 6, a video signal line Dn and a gray scale signal line Kn.

FIG. 7 illustrates waveforms of voltages applied on the gate electrodes of the respective switching TFTs, the video-signal line (Dn) and the gray scale signal line (Kn), respectively, shown in FIG. 6, and a waveform of a drive current flowing in the EL element shown in FIG. 6.

In FIG. 7, Vre denotes a voltage applied on the gate electrode of the third switching TFT (Qs3 (m,n)), Vg1 denotes a scanning clock applied on the gate electrode of the switching TFT (Qs (m,n)), Vsig denotes an analog video signal supplied to the video signal line (Dn), Vg2 denotes a voltage applied on the gate electrode of the second switching TFT (Qs2 (m,n)), V gray denotes a ramp voltage applied on the gray scale signal line (Kn), and Ioled denotes a drive current which flows in the EL element (OLED (m,n)).

In the following, a method of driving the display device of the present embodiment will be explained referring to FIG. 7.

One frame period is divided into a scanning time and a light emission time in the present embodiment also.

In the present embodiment, since the voltage Vre goes to the H level in a first period within the scanning time, the third switching TFT (Qs3 (m,n)) in each pixel is turned ON, and the input terminal and the output terminal are short-circuited in each pixel.

Thus, an input terminal node N1 of the inverter circuit is set to a voltage (Vcn) at which a current which flows in the PMOS transistor (PM (m,n)) becomes equal to a current which flows in the NMOS transistor (NM (m,n)).

In this case, even if threshold voltages (Vth) and mobility (μ) of the PMOS transistors (PM (m,n)) and the NMOS transistors (NM (m,n)) vary from pixel to pixel due to local variations in crystallinity of the semiconductor thin films (polysilicon films) forming the PMOS transistors (PM (m,n)) and the NMOS transistors (NM (m,n)), the above-mentioned voltage (Vcn) varies correspondingly to the above-mentioned local variations in crystallinity of the semiconductor thin films.

Next, during a second period within the scanning time, succeeding the first period, scanning signal lines (G1 to Gm) are successively scanned line by line, that is to say, the scanning clock is successively applied on the scanning lines G line by line, and thereby analog video signal voltages are written into all the storage capacitance elements (Cst).

When the scanning clock applied on the gate electrode of the switching TFT (Qs (m,n)) goes the H level, the switching TFT (Qs (m,n)) is turned ON, and an analog video signal voltage (Vsig) is stored into the storage-capacitance elements (Cst (m,n)) from the video signal line (Dn) via the switching TFT (Qs (m,n)) and the supplied voltages are stored in the storage capacitance elements (Cst (m,n)).

In this case, the PMOS transistor (PM (m,n)) in the inverter circuit is in an OFF state, and therefore, all the EL elements (OLED) cease to emit light.

Next, during the light-emission period, the voltage (Vg2) goes to the H level, thereby the switching TFT (Qs2 (m,n)) goes to the ON state, and the ramp voltage are supplied to the storage capacitance element (Cst) from the gray-scale-signal line (Kn). The ramp voltage shown in FIG. 7 is a voltage which varies from the first voltage (V1) to the second voltage (V2) with a specified slope.

Thus, a voltage at the input terminal node (N1) changes to a voltage (Vcn−(Vsig−V1)) and the PMOS transistor (PM (m,n)) of the inverter circuit is turned ON, and consequently, the EL element (OLED) emits light.

When the ramp voltage shown in FIG. 7 rises from the first-level voltage (V1) and reaches a voltage equal to the voltage (designated GRAY SCALE VOLTAGE in FIG. 7) stored in the storage capacitance element (Cst (m,n)), the PMOS transistor (PM (m,n)) of the inverter circuit is turned OFF, and consequently, the EL element (OLED) ceases to emit light.

In this case, the currents (Ioled in FIG. 7) which flow in the respective EL elements (OLED) are constant and luminance of light emission of each pixel varies with the EL-luminescent time of the EL element (OLED) in each pixel. The higher the luminance of light emission of a pixel, the longer the EL-luminescen time of the EL-elements (OLED).

Further, in the present embodiment, even if the threshold voltages (Vth), the mobility (μ), etc. of the PMOS transistors (PM (m,n)) and NMOS transistors (NM (m,n)) of the inverter circuit vary from pixel by pixel, the above-mentioned voltages (Vcn) vary correspondingly to local variations in crystallinity of their semiconductor thin films. Therefore, the present embodiment reduces display variations among a plurality of pixels caused by the variations in the characteristics of the thin film transistors of the inverter circuits, and is capable of providing uniform displays free from uneveness.

In the present embodiment, as shown in FIG. 7, the higher luminance of the light emission, the larger a voltage difference between the first-level voltage (V1) and the analog video signal voltage (designated GRAY SCALE VOLTAGE in FIG. 7) stored in the storage capacitance element (Cst), and the lower the luminance of the light emission, the smaller the voltage difference between the first-level voltage (V1) and the analog video signal voltage (designated GRAY SCALE VOLTAGE in FIG. 7) stored in the storage capacitance element (Cst).

As mentioned in the above, in the present embodiment, since the light emission of all the EL elements (OLED) ceases during the scanning time of one frame period, and even when moving pictures are displayed, the degradation in quality of the displayed pictures can be reduced.

In the present embodiment, the configuration of the whole display section including the matrix display section and the driving circuits of the display device is the same as that shown in FIG. 4. The above-mentioned ramp voltage is generated in the ramp voltage generator circuit 22.

Also in the present embodiment, as in Embodiment 2, the ramp voltages may be configured to be varied from the first-level voltage (V1) to the second-level voltage (V2) plural times during one light emission time.

Embodiment 4

With the pixel configuration of the display device of the above-mentioned Embodiment 3, even when gray scale voltages (that is, voltages stored in the storage capacitance elements (Cst)) are selected to be a fixed value, EL-luminescent times for the EL elements (OLED) of pixels of different colors can be adjusted by changing a ratio in duration of ramp voltages supplied to the gray scale signal lines (K).

Figure 8A:
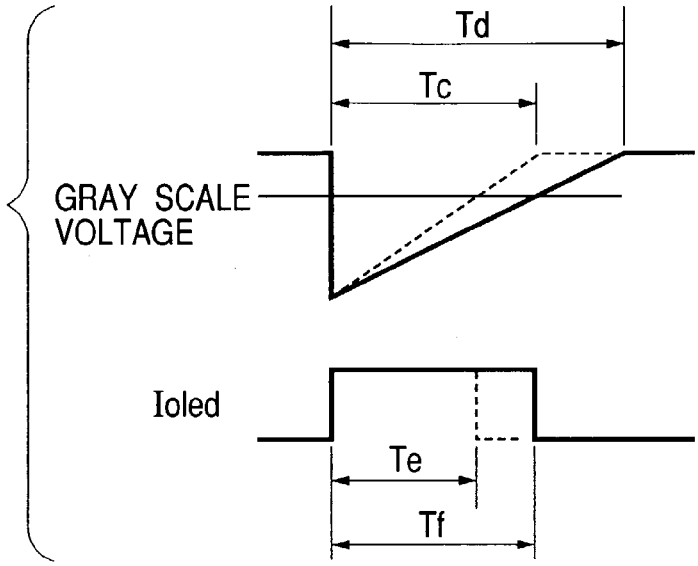
FIGS. 8A to 8C are diagrams showing waveforms of ramp voltages supplied to a gray scale signal line K in a display device in Embodiment 4 according to the present invention.

The following explains this embodiment by referring to FIG. 8A.

Now, it is assumed that a gray scale voltage is a voltage as shown in FIG. 8A. If a ratio in duration of a ramp voltage supplied to the gray scale signal line (K) is 100%, the EL-luminescent time of the EL element (OLED) (in other words, a time during which a drive current flows in the EL element (OLED)) is a time (Tf) shown in 8A. On the other hand, if the ratio in duration of the ramp voltage supplied to the gray scale signal line (K) is (Tc/Td)×100%, the EL-luminescent time of the EL element (OLED) changes to a time (Te) shown in 8A.

Thus, by changing the ratio in duration (or a slope) of a ramp voltage supplied to the gray-scale signal line (K), the EL-luminescent time of the EL element (OLED) can be varied.

In general, EL elements (OLED) of red, green and blue used for AMOLED produce luminance of values different from each other for the same drive current. This difference in luminance amomg among the EL elements of red, green and blue are observed as fine unevenness on a display screen as mentioned in the above.

In the present embodiment, the ratios in duration of ramp voltages supplied to the gray scale signal lines (K) are varied for respective emission colors such that the respective EL-luminescent times of the EL elements (OLED) are adjusted to suppress nonuniformity in display due to difference in luminance among the EL elements (OLED) of red, green and blue for the same drive current.

Figure 8B:
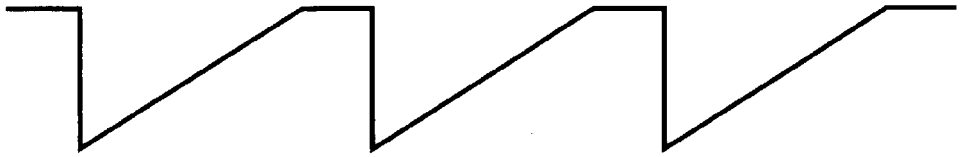
Figure 8C:
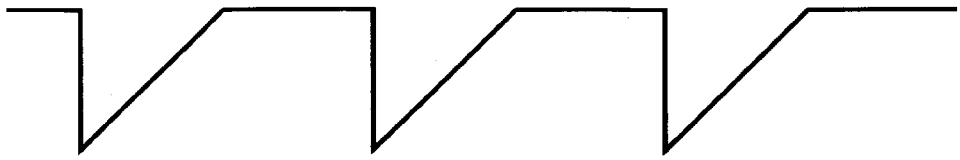

In the present embodiment, for the EL element (OLED) using organic electroluminescent material of higher luminous efficacy among the EL elements (OLED) of red, green and blue, the ratio in duration of a ramp voltage supplied to the gray scale signal line (K) is made smaller (or the slope of the ramp voltage is made greater) as shown in FIG. 8C, and thereby the EL-luminescent time of the EL element (OLED) of the higher luminous efficacy is made shorter. On the other hand, for the EL element (OLED) using organic electroluminescent material of lower luminous efficacy, the ratio in duration of a ramp voltage supplied to the gray scale signal line (K) is made greater (or the slope of the ramp voltage is made smaller) as shown in FIG. 8B, and thereby the EL-luminescent time of the EL element (OLED) of the lower luminous efficacy is made longer.

As described above, in the present embodiment, the ratios in duration of the ramp voltages supplied to the gray scale signal lines (K) is adjusted in accordance with the luminous efficacies of the respective EL elements (OLED) of pixels of red, green and blue. Without adjusting analog video signal voltages supplied from the video signal lines (D), the present embodiment is capable of making each of the red-light-emitting, green-light-emitting, and blue-light-emitting pixels emit light with a balance in luminance of light emission between the red-light-emitting, green-light-emitting, and blue-light-emitting pixels, and thereby providing a high-quality display.

Further, in the present embodiment, the configuration of Embodiment 1 may be adopted as its pixel configuration, and also the ramp voltages may be varied from the first-level voltage (V1) to the second-level voltage (V2) plural times as described in the embodiment 2.

Embodiment 5

With the pixel configuration of the display device of the embodiment 3, even when gray scale voltages (that is, voltages stored in the storage capacitance elements (Cst)) are selected to be a fixed value, EL-luminescent times for the EL elements (OLED) of pixels of different colors can be adjusted by changing waveforms of ramp voltages supplied to the gray scale signal lines (K).

Figure 9A:
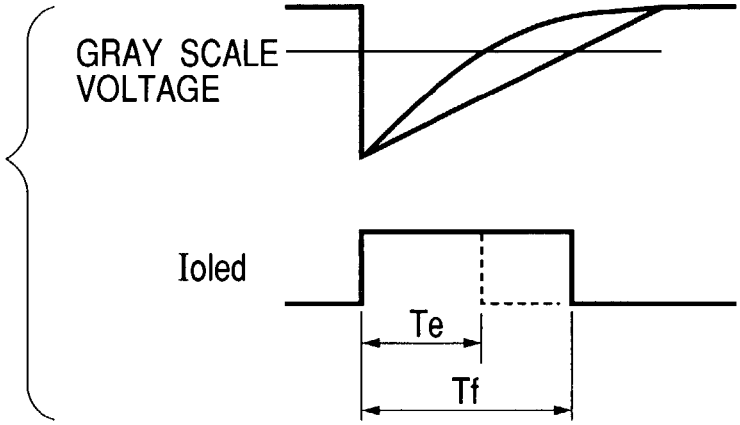
FIGS. 9A to 9C are diagrams showing voltage waveforms of ramp voltages supplied to a gray scale signal line K in a display device of Embodiment 5 according to the present invention.

The following explains this embodiment by referring to FIG. 9A.

Now, it is assumed that a gray scale voltage is a voltage as shown in FIG. 9A. If a waveform of a voltage supplied to the gray scale signal line (K) is a ramp voltage which varies with a constant slope (or a voltage which varies linearly with time), the EL-luminescent time (a time during which a drive current flows in the EL element (OLED)) of the EL element (OLED) is a time Tf indicated in FIG. 9A. On the other hand, if a slope of a voltage supplied to the gray scale signal line (K) varies continuously with time (that is, if a voltage varies nonlinearly with time), the EL-luminescent time of the EL element (OLED) is a time Te indicated in FIG. 9A.

As explained above, the EL-luminescent time of the EL element (OLED) can be varied by changing the waveform of a voltage to be supplied to the gray scale signal line (K).

Generally, the red-light-emitting, green-light-emitting, and blue-light-emitting EL elements (OLED) used for AMOLED have nonlinear light emission characteristics (voltage-current-voltage characteristics, luminance-voltage characteristics), different for different emission colors. Differences in the light emission characteristics among the red-light-emitting, green-light-emitting, and blue-light-emitting EL elements are observed as fine nonuniformity on a display screen as explained above.

The present embodiment suppresses nonuniformity in display caused by the differences in light emission characteristics among the red-light-emitting, green-light-emitting, and blue-light-emitting EL elements (OLED) by varying waveforms of the voltages supplied to the gray scale signal line (K), and thereby varying the EL-luminescent times of the EL elements (OLED).

Figure 9B:
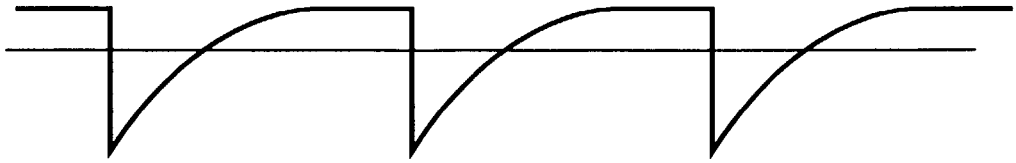
Figure 9C:
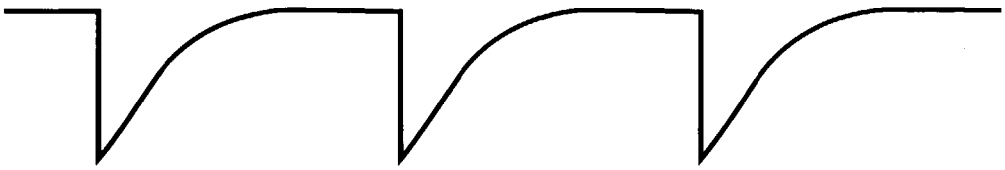

The present embodiment performs gamma correction by varying the waveforms of voltages supplied to the gray scale signal lines (K) correspondingly to respective luminance-voltage characteristics of the red-light-emitting, green-light-emitting, and blue-light-emitting EL elements (OLED) determined by their organic electroluminescent materials as shown in FIGS. 9B and 9C.

The present embodiment does not need A/D converters, D/A converter and memories for storing a gamma correction table which are required for the gamma correcion in the third conventional technique, and the present embodiment is simple in configuration compared with the third conventional technique and consequently, is capable of reducing its cost compared with the third conventional technique.

Moreover, the present embodiment is capable of eliminating local variations in characteristics such as variations in the luminance among pixels, which have not been eliminated by the third conventional technique.

Thus, the present embodiment is capable of balancing the light emission characteristics among the red-light-emitting, green-light-emitting, and blue-light-emitting EL elements (OLED) without adjusting analog video signal voltages supplied from the video signal lines (D), balacing emission colors of red, green and blue, and thereby producing high-quality images.

The present embodiment can employ the pixel configuration of Embodiment 1, and also the ramp voltages may be varied from the first-level voltage (V1) to the second-level voltage (V2) plural times as in the case of Embodiment 2.

The invention made by the present inventors has been explained concretely in connection with the preferred embodiments according to the present invention, but the present invention is not limited to the above-mentioned preferred embodiments. The preferred embodiments are illustrative and not restrictive, and various kinds of modifications may be made without departing from the true scope and spirit of the invention.

Some of the advantages provided by representative ones of the present inventions disclosed in the present specification, will be briefly explained as follows:

(1) The display device according to the present invention is capable of make red-light-emitting, green-light-emitting, and blue-light-emitting pixels emit light with luminance of light emission balanced among the three colors, and thereby producing a high-quality display.

(2) The display device according to the present invention is capable of producing balanced emission colors of red, green and blue, and thereby producing a high-quality display.

What is claimed is:

1. A display device comprising: a plurality of red pixels each provided with a current-driven type red-light-emitting element; a plurality of green pixels each provided with a current-driven type green-light-emitting element; a plurality of blue pixels each provided with a current-driven type blue-light-emitting element, each of said red, green and blue pixels being provided with a drive transistor for supplying a drive current to a corresponding one of said current-driven type red-light-emitting, green-light-emitting, and blue-light-emitting elements, a switching transistor, a storage capacitance element coupled to said switching transistor, a comparator with an output terminal thereof coupled to a gate electrode of said drive transistor, a first input terminal of said comparator supplied with a voltage stored in said storage capacitance element and a second input terminal of said comparator supplied with a gray scale control voltage; a first circuit for writing a video signal voltage into said storage capacitance element of a respective one of said red, green, and blue pixels during a first portion of one frame period at a beginning thereof by applying a scanning drive signal on a gate electrode of said switching transistor of said respective one of said red, green, and blue pixels; and a second circuit for supplying, as said gray scale control voltage, a first voltage of a first level for turning off all of said drive transistors during said first portion of said one frame period, then at least one ramp voltage varying from said first voltage of said first level to a second voltage of a second level different from said first level during a second portion of said one frame period succeeding said first portion; wherein a waveform of each of said at least one ramp voltage is determined by light emission characteristics associated with a corresponding one of said current-driven type red-light-emitting, green-light-emitting, and blue-light-emitting elements.

2. A display device according to claim 1, wherein said light emission characteristics are luminous efficacies of said red-light-emitting, green-light-emitting, and blue-light-emitting elements.

3. A display device according to claim 1, wherein said light emission characteristics are luminance-voltage characteristics of said red-light-emitting, green-light-emitting, and blue-light-emitting elements.

4. A display device according to claim 1, further comprising a plurality of video signal lines, a plurality of gray scale signal lines, a plurality of current supply lines, and a plurality of scanning signal lines, wherein said red, green, and blue pixels are arranged in a matrix configuration, each of said plurality of video signal lines is disposed for one of columns of said matrix configuration of said red, green, and blue pixels, and supplies said video signal voltage to said storage capacitance element of a corresponding one of said red, green, and blue pixels when said switching transistor of said corresponding one of said red, green, and blue pixels is turned on, each of said plurality of gray scale signal lines is disposed for one of columns of said matrix configuration of said red, green, and blue pixels, and supplies said gray scale control voltage to said second input terminal of said comparator of a corresponding one of said red, green, and blue pixels, each of said plurality of current supply lines is disposed for one of columns of said matrix configuration of said red, green, and blue pixels, and supplies said drive current to a corresponding one of said current-driven type red-light-emitting, green-light-emitting, and blue-light-emitting elements via said drive transistor of a corresponding one of said red, green, and blue pixels, and said plurality of scanning signal lines are disposed for respective rows of said matrix configuration of said red, green, and blue pixels, and supply said scanning drive signal to said gate electrodes of said switching transistors of corresponding ones of said red, green, and blue pixels in rows of said matrix configuration, row by row and successively.

5. A display device comprising: a plurality of red pixels each provided with a current-driven type red-light-emitting element; a plurality of green pixels each provided with a current-driven type green-light-emitting element; a plurality of blue pixels each provided with a current-driven type blue-light-emitting element, each of said red, green and blue pixels being provided with an inverter circuit having an output terminal thereof coupled to a corresponding one of said current-driven type red-light-emitting, green-light-emitting, and blue-light-emitting elements, a switching transistor, a storage capacitance element coupled between said switching transistor and an input terminal of said inverter circuit; a first circuit for short-circuiting between said input and output terminals of said inverter circuit of each of said red, green and blue pixels during a first portion of one frame period at a beginning thereof; a second circuit for writing a video signal voltage into said storage capacitance element of a respective one of said red, green, and blue pixels by applying a scanning drive signal on a gate electrode of said switching transistor of said respective one of said red, green, and blue pixels, during a second portion of said one frame period succeeding said first portion; and a third circuit for supplying at least one ramp-shaped gray scale control voltage varying from a first voltage of a first level to a second voltage of a second level different from said first level to said first terminal of said storage capacitance element of a respective one of said red, green, and blue pixels during a third portion of said one frame period succeeding said second portion; wherein a waveform of each of said at least one ramp-shaped gray scale control voltage is determined by light emission characteristics associated with a corresponding one of said current-driven type red-light-emitting, green-light-emitting, and blue-light-emitting elements.

6. A display device according to claim 5, wherein said light emission characteristics are luminous efficacies of said current-driven type red-light-emitting, green-light-emitting, and blue-light-emitting elements.

7. A display device according to claim 5, wherein said light emission characteristics are luminance-voltage characteristics of said current-driven type red-light-emitting, green-light-emitting, and blue-light-emitting elements.

8. A display device according to claim 5, further comprising a plurality of second switching transistors each provided to a respective one of said red, green, and blue pixels, wherein each of said plurality of second switching transistors is coupled to said first terminal of said storage capacitance element of said respective one of said red, green, and blue pixels, and is turned on during said third portion of said one frame period such that said at least one ramp-shaped gray scale control voltage is supplied to said first terminal of said storage capacitance element.

9. A display device according to claim 5, further comprising a plurality of video signal lines, a plurality of gray scale signal lines, a plurality of current supply lines, and a plurality of scanning signal lines, wherein said red, green, and blue pixels are arranged in a matrix configuration, each of said plurality of video signal lines is disposed for one of columns of said matrix configuration of said red, green, and blue pixels, and supplies said video signal voltage to said storage capacitance element of a corresponding one of said red, green, and blue pixels when said switching transistor of said corresponding one of said red, green, and blue pixels is turned on, each of said plurality of gray scale signal lines is disposed for one of columns of said matrix configuration of said red, green, and blue pixels, and supplies said gray scale control voltage to said first terminal of said storage capacitance element of a corresponding one of said red, green, and blue pixels, each of said plurality of current supply lines is disposed for one of columns of said matrix configuration of said red, green, and blue pixels, and supplies a drive current to a corresponding one of said current-driven type red-light-emitting, green-light-emitting, and blue-light-emitting elements via said inverter circuit of a corresponding one of said red, green, and blue pixels, and said plurality of scanning signal lines are disposed for respective rows of said matrix configuration of said red, green, and blue pixels, and supply said scanning drive signal to said gate electrodes of said switching transistors of corresponding ones of said red, green, and blue pixels in rows of said matrix configuration, row by row and successively.

10. A display device comprising: a plurality of pixels, each of said pixels being provided with a current-driven type light-emitting element, a drive transistor for supplying a drive current to said current-driven type light-emitting element, a switching transistor, a storage capacitance element coupled to said switching transistor, a comparator with an output terminal thereof coupled to a gate electrode of said drive transistor, a first input terminal of said comparator supplied with a voltage stored in said storage capacitance element, and a second input terminal of said comparator supplied with a gray scale control voltage; a first circuit for writing a video signal voltage into said storage capacitance element of a respective one of said plurality of pixels during a first portion of one frame period at a beginning thereof by applying a scanning drive signal on a gate electrode of said switching transistor of said respective one of said plurality of pixels; and a second circuit for supplying, as said gray scale control voltage, a first voltage of a first level for turning off said drive transistor in said respective one of said plurality of pixels during said first portion of said one frame period, then at least one ramp voltage varying from said first voltage of said first level to a second voltage of a second level different from said first level during a second portion of said one frame period succeeding said first portion.

11. A display device according to claim 10, wherein said first circuit ceases to apply said scanning drive signal on said gate electrode of said switching transistor of said respective one of said plurality of pixels during said second portion.

12. A display device according to claim 10, further comprising a plurality of video signal lines, a plurality of gray scale signal lines, a plurality of current supply lines, and a plurality of scanning signal lines, wherein said plurality of pixels are arranged in a matrix configuration, each of said plurality of video signal lines is disposed for one of columns of said matrix configuration of said plurality of pixels, and supplies said video signal voltage to said storage capacitance element of a corresponding one of said plurality of pixels when said switching transistor of said corresponding one of said plurality of pixels is turned on, each of said plurality of gray scale signal lines is disposed for one of columns of said matrix configuration of said plurality of pixels, and supplies said gray scale control voltage to said second input terminal of said comparator of a corresponding one of said plurality of pixels, each of said plurality of current supply lines is disposed for one of columns of said matrix configuration of said plurality of pixels, and supplies said drive current to a corresponding one of said plurality of said current-driven type light-emitting, elements via said drive transistor of a corresponding one of said plurality of pixels, and said plurality of scanning signal lines are disposed for respective rows of said matrix configuration of said plurality of pixels, and supply said scanning drive signal to said gate electrodes of said switching transistors of corresponding ones of said plurality of pixels in rows of said matrix configuration, row by row and successively.

13. A display device comprising: a plurality of pixels, each of said plurality of pixels being provided with a current-driven type light-emitting element, an inverter circuit having an output terminal thereof coupled to said current-driven type light-emitting elements, a switching transistor, a storage capacitance element coupled between said switching transistor and an input terminal of said inverter circuit; a first circuit for short-circuiting between said input and output terminals of said inverter circuit of each of said plurality of pixels during a first portion of one frame period at a beginning thereof a second circuit for writing a video signal voltage into said storage capacitance element of a respective one of said plurality of pixels by applying a scanning drive signal on a gate electrode of said switching transistor of said respective one of said plurality of pixels, during a second portion of said one frame period succeeding said first portion; a third circuit for supplying at least one ramp-shaped gray scale control voltage varying from a first voltage of a first level to a second voltage of a second level different from said first level to said first terminal of said storage capacitance element of a respective one of said plurality of pixels during a third portion of said one frame period succeeding said second portion.

14. A display device according to claim 13, wherein said second circuit ceases to apply said scanning drive signal on said gate electrode of said switching transistor of said respective one of said plurality of pixels during said first and third portions of said one frame period.

15. A display device according to claim 13, further comprising a plurality of second switching transistors each provided to a respective one of said plurality of pixels, wherein each of said plurality of second switching transistors is coupled to said first terminal of said storage capacitance element of said respective one of said plurality of pixels, and is turned on during said third portion of said one frame period such that said at least one ramp-shaped gray scale control voltage is supplied to said first terminal of said storage capacitance element.

16. A display device according to claim 13, further comprising a plurality of video signal lines, a plurality of gray scale signal lines, a plurality of current supply lines, and a plurality of scanning signal lines, wherein said plurality of pixels are arranged in a matrix configuration, each of said plurality of video signal lines is disposed for one of columns of said matrix configuration of said plurality of pixels, and supplies said video signal voltage to said storage capacitance element of a corresponding one of said plurality of pixels when said switching transistor of said corresponding one of said plurality of pixels is turned on, each of said plurality of gray scale signal lines is disposed for one of columns of said matrix configuration of said plurality of pixels, and supplies said gray scale control voltage to said first terminal of said storage capacitance element of a corresponding one of said plurality of pixels, each of said plurality of current supply lines is disposed for one of columns of said matrix configuration of said plurality of pixels, and supplies a drive current to a corresponding one of said current-driven type light-emitting elements via said inverter circuit of a corresponding one of said plurality of pixels, and said plurality of scanning signal lines are disposed for respective rows of said matrix configuration of said plurality of pixels, and supply said scanning drive signal to said gate electrodes of said switching transistors of corresponding ones of said plurality of pixels in rows of said matrix configuration, row by row and successively.

* * * * *